US008784144B2

(12) United States Patent
Hirabayashi et al.

(10) Patent No.: US 8,784,144 B2
(45) Date of Patent: Jul. 22, 2014

(54) TERMINAL FITTING HAVING A RETRACTED PORTION EXTENDING FROM ONE SIDE PLATE TO ANOTHER SIDE PLATE

(75) Inventors: Osamu Hirabayashi, Yokkaichi (JP); Michiaki Okamoto, Yokkaichi (JP); Yutaka Noro, Yokkaichi (JP); Daisuke Hirasawa, Yokkaichi (JP); Yoshihiro Mizutani, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 31 days.

(21) Appl. No.: 13/611,320

(22) Filed: Sep. 12, 2012

(65) Prior Publication Data

US 2013/0065436 A1 Mar. 14, 2013

(30) Foreign Application Priority Data

Sep. 14, 2011 (JP) ..... 2011-200419

(51) Int. Cl.
*H01R 11/22* (2006.01)

(52) U.S. Cl.
USPC ..... 439/852

(58) Field of Classification Search
USPC ..... 439/851–852, 595
See application file for complete search history.

(56) References Cited

U.S. PATENT DOCUMENTS

| | | | | |
|---|---|---|---|---|
| 5,593,328 | A | 1/1997 | Okada et al. | |
| 7,232,339 | B1 | 6/2007 | Wilson et al. | |
| 7,374,465 | B2 | 5/2008 | Tanaka | |
| 8,241,076 | B2 * | 8/2012 | Kubota | 439/852 |

FOREIGN PATENT DOCUMENTS

| | | |
|---|---|---|
| JP | 1-158671 | 1/1989 |

* cited by examiner

*Primary Examiner* — Chandrika Prasad
(74) *Attorney, Agent, or Firm* — Gerald E. Hespos; Michael J. Porco; Matthew T. Hespos

(57) ABSTRACT

A rectangular tube (10) of a terminal fitting (T) includes a lid plate (16) extending substantially at a right angle from the extending end of a right side plate (15) and formed with a locking hole (20) extending over the entire width. A front plate (19F) is cantilevered from the right side plate (15) and arranged before the locking hole (20). A rear plate (19R) is cantilevered from the right side plate independently of the front plate (19F) and is behind and adjacent to the locking hole (20). A retracted portion (21) is formed over the entire width at the rear plate (19R), retracted inwardly of the rectangular tube (10) from the front plate (19F) to provide a height difference within the range of an engagement margin with a locking projection (34) and capable of facing a rear end of the locking projection (34).

14 Claims, 7 Drawing Sheets

TERMINAL FITTING HAVING A RETRACTED PORTION EXTENDING FROM ONE SIDE PLATE TO ANOTHER SIDE PLATE

BACKGROUND OF THE INVENTION

1. Field of the Invention

The invention relates to a terminal fitting and to a connector provided therewith.

2. Description of the Related Art

U.S. Pat. No. 7,374,465 discloses a female terminal fitting with a rectangular tube at a front end and a wire crimping portion in the form of an open barrel at a rear end. The wire crimping portion defines an open barrel with a bottom wall and two side plates extending from left and right sides of the bottom wall. The rectangular tube has a base plate connected to the bottom wall of the wire crimping portion, two side plates extending at substantially right angles from left and right sides of the base plate and a lid plate extending at a substantially right angle from the end of at least one side plate opposite the base plate. The base plate is formed with a locking hole. The terminal fitting inserted into a terminal accommodating chamber of a housing from behind and a locking projection of a locking lance formed in the terminal accommodating chamber engages the edge of the locking hole to prevent the terminal fitting from coming out backward.

A part of the base plate behind the locking hole is indented inwardly of the rectangular tube to form a retracted portion. Thus the base plate has a height difference between the front and rear sides of the rear edge of the locking hole. A rear end part of the locking projection of the locking lance faces the outer surface of this retracted portion, and a part of the locking projection before the retracted portion is in the opening area of the locking hole. According to this configuration, a dimension of the locking hole in forward and backward directions can be reduced as compared with the case where an opening range of the locking hole in forward and backward directions extends from the front end to the rear end of the locking projection, and the terminal fitting can be made smaller by reducing a length of the rectangular tube in forward and backward directions by that much.

In the above-described terminal fitting, the retracted portion is formed by cutting a part of the base plate and bending the cut part. The side plates are connected to the left and right edges of this base plate. Thus, a formation range of the retracted portion in a width direction is limited to a range inwardly of the inner side surfaces of the side plates. That is, it is structurally impossible to form the retracted portion over the entire width of the rectangular tube including plate thickness ranges of the side plates. Since the locking projection of the locking lance is accommodated in a space secured by indenting the retracted portion inwardly of the rectangular tube, the width of the locking lance is limited to the entire width of the retracted portion or smaller. In other words, an engagement margin between the locking lance and the locking hole in the width direction is limited to the formation range of the retracted portion in the width direction.

The invention was completed in view of the above situation and an object thereof is to ensure a large engagement margin between a lock and a locking hole.

SUMMARY OF THE INVENTION

The invention relates to a terminal fitting with a tube at a front end part. A locking hole is formed is formed in the tube. A locking projection of a lock formed in a terminal accommodating chamber engages a front end edge of the locking hole when the terminal fitting is inserted properly in the terminal accommodating chamber to retain the terminal fitting. The tube comprises a base plate and first and second side plates extending from the base plate. A lid plate extends between the side plates and is formed with the locking hole. The lid plate includes a front and rear plates cantilevered from the first side wall. The front plate defines a part of the lid plate before the locking hole and the rear plate defines a part of the lid plate behind the locking hole. A retracted portion is formed in the rear plate and is retracted inwardly relative to the front plate to provide a height difference within the range of an engagement margin with the locking projection and capable of facing a rear end part of the locking projection.

The locking hole preferably extends over the entire width of the lid plate. The retracted portion also preferably is formed over the entire width. Additionally, the front and the rear plates of the lid plate portion preferably are cantilevered from the side plate independently of each other. Thus, the position of a fold line along which the rear plate and the side plate are connected at a substantially right angle can be set at a position displaced inward of the rectangular tube from the position of a fold line along which the front plate and the side plate are connected at a substantially right angle, and the height difference can be provided between the front and the rear plates. The rear plate is cantilevered and hence can extend over the entire width of the rectangular tube if an extending dimension is set appropriately. Thus, it is possible to form the retracted portion over the entire width of the rectangular tube and to ensure a large engagement margin between the locking lance and the locking hole in the width direction.

At least one posture stabilizing portion preferably is formed behind an area of the retracted portion substantially facing the locking projection and projecting out of the rectangular tube from the outer surface of the retracted portion. The posture stabilizing portion enables the lid plate to be held in contact with the inner surface of the terminal accommodating chamber at two positions, i.e. a position before the locking hole and a position after the locking hole, thereby stabilizing the posture of the tube in the terminal accommodating chamber.

A distance from the rear end of the front plate to the front end of the rear plate preferably is shorter than a distance from the front end to the rear end of the locking projection in forward and backward directions.

A formation range of the retracted portion in forward and backward directions preferably extends substantially from the front end edge of the rear plate to a position slightly before a substantial center of the rear plate in forward and backward directions.

The retracted portion preferably is in a positional relationship to be retracted in a direction away from the outer surface of a main body of the lock and in an inward direction of the tube as compared with the front plate.

According to a further aspect of the invention, there is provided a connector comprising: at least one terminal accommodating chamber and at least one of the above-described terminal fittings to be inserted into the respective terminal accommodating chamber. A tube of the one a terminal fitting includes a locking hole formed at a front end part and which is be retained not to come off backward by the engagement of the front end edge of the locking hole with a locking projection of a locking portion formed in the terminal accommodating chamber in a state where the terminal fitting is properly inserted in the terminal accommodating chamber.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
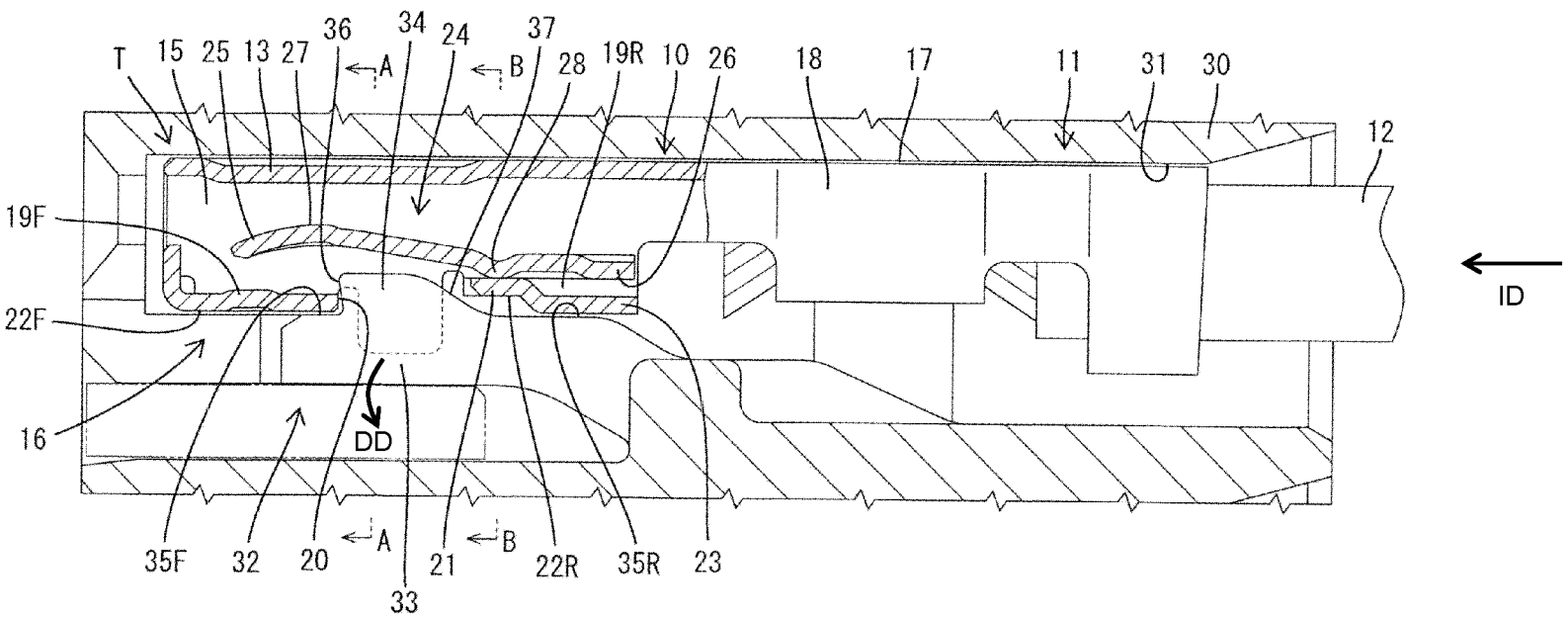
FIG. 1 is a section showing a state where a terminal fitting is inserted in a terminal accommodating chamber in one embodiment.
Figure 2:
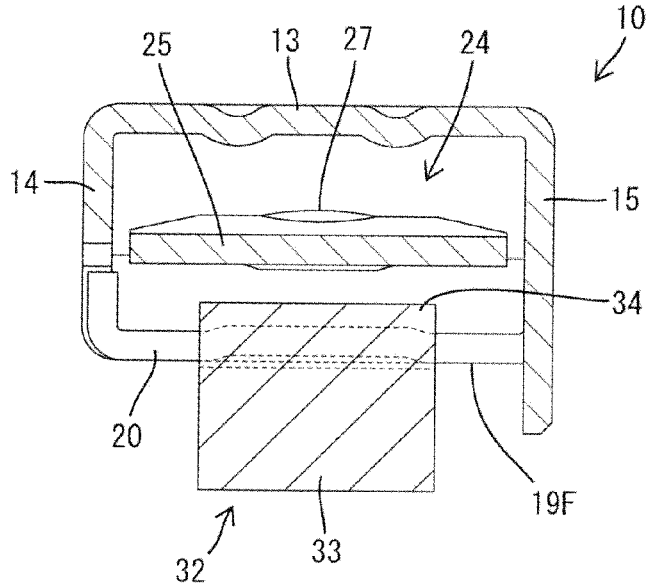
FIG. 2 is a section along A-A of FIG. 1.

A terminal fitting in accordance with the invention is identified by the letter T in FIGS. 1, 5 to 7. The terminal fitting T is a female terminal formed with a substantially rectangular tube 10 at a front and a wire crimping portion 11 at a rear end. A front part of a wire 12 is to be connected to the wire crimping portion 11. As shown in FIG. 1, the terminal fitting T is to be inserted from behind into a terminal accommodating chamber 31 formed in a housing 30. In the following, a connection side of the terminal fitting T with a mating terminal fitting (not shown) is referred to as the front.

A locking lance 32 is cantilevered forward from a lower wall of the terminal accommodating chamber 31 and is configured for holding and retaining the terminal fitting T that has been inserted properly inserted into the terminal accommodating chamber 31. The locking lance 32 has a main body 33 that is resiliently deformable to retract out and down. A locking projection 34 projects up from the surface of the main body 33 and is in an insertion space for the terminal fitting T in the terminal accommodating chamber 31 for engaging the terminal fitting T when the locking lance 32 is not deformed resiliently, as shown in FIG. 1. However, the locking projection 34 is retracted from the insertion area for the terminal fitting T in the terminal accommodating chamber 31 when the locking lance 32 is deformed out and down in a direction DD intersecting an insertion direction ID of the terminal fitting T into the accommodating chamber 31.

The locking projection 34 is arranged in a substantially in a central part of the main body 33 in forward and backward directions. A front receiving surface 35F is defined at a front area of the upper surface of the main body 33 forward of the locking projection 34 and a rear receiving surface 35R is defined at a rear area of the upper surface of the main body 33 behind the locking projection 34. The front and rear receiving surfaces 35F, 35R are arranged to contact the properly inserted terminal fitting T from below when the locking lance 32 is not deformed resiliently. Thus, the front and rear receiving surfaces 35F, 35R are capable of supporting the terminal fitting T from below.

The locking projection 34 has a wide substantially rectangular shape and is longer in forward and backward directions than in a height direction when viewed laterally. A locking surface 36 is defined at the front end of the locking projection 34 and is substantially perpendicular to the inserting direction ID of the terminal fitting T when the locking lance 32 is not deformed. The upper surface of the locking projection 34 is substantially parallel to the inserting direction ID of the terminal fitting T when the locking lance 32 is not deformed. An inclined surface 37 is formed at the rear end of the locking projection 34 and inclines out and down toward the back with respect to the inserting direction ID of the terminal fitting T when the locking lance 32 is not deformed. The entire area of the locking surface 36 from the lower end to the upper end defines an engagement margin with the terminal fitting T in the vertical direction.

References to the vertical direction in the following paragraphs are based on the state where the terminal fitting T is inserted in the terminal accommodating chamber 31. As shown in FIGS. 1 to 7, the rectangular tube 10 has a substantially flat rectangular horizontal base plate 13, a substantially flat rectangular left side plate 14 extending substantially perpendicularly down from the left side of the base plate 13, a substantially flat rectangular right side plate 15 extending substantially perpendicularly down from the right side of the base plate 13 and a substantially flat rectangular lid 16 extending substantially perpendicularly leftward from the extending lower end of the right side plate 15. The front and rear ends of the rectangular tube 10 are open toward the outside. As shown in FIGS. 1, 5 to 7, a rear end of the base plate 13 is connected to the front end of a bottom wall 17 of the wire crimping portion 11, and rear ends of the left and right side plates 14, 15 are connected to base end parts of lateral walls of the left and right crimping pieces 18 extending from both lateral sides of the bottom wall 17.

Figure 5:
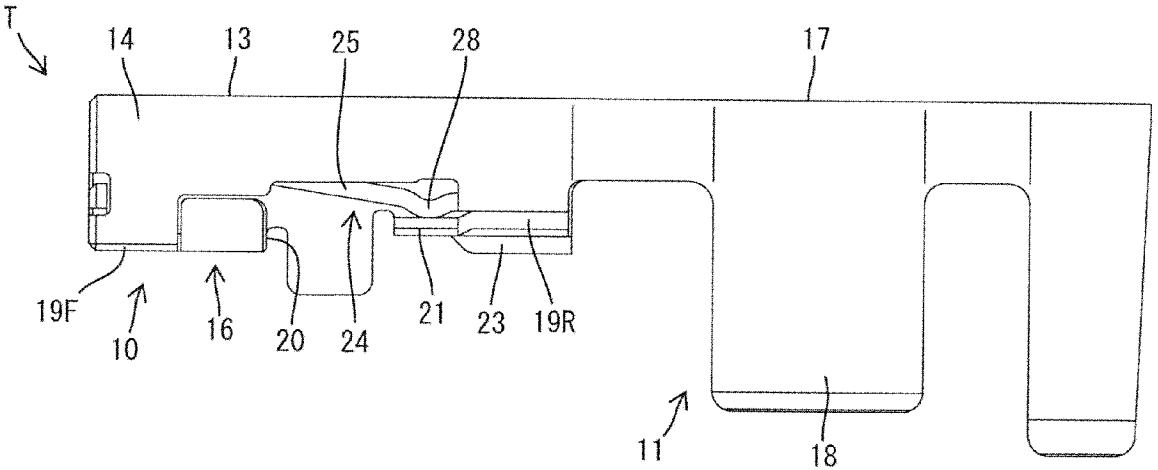
FIG. 5 is a side view of the terminal fitting.
Figure 6:
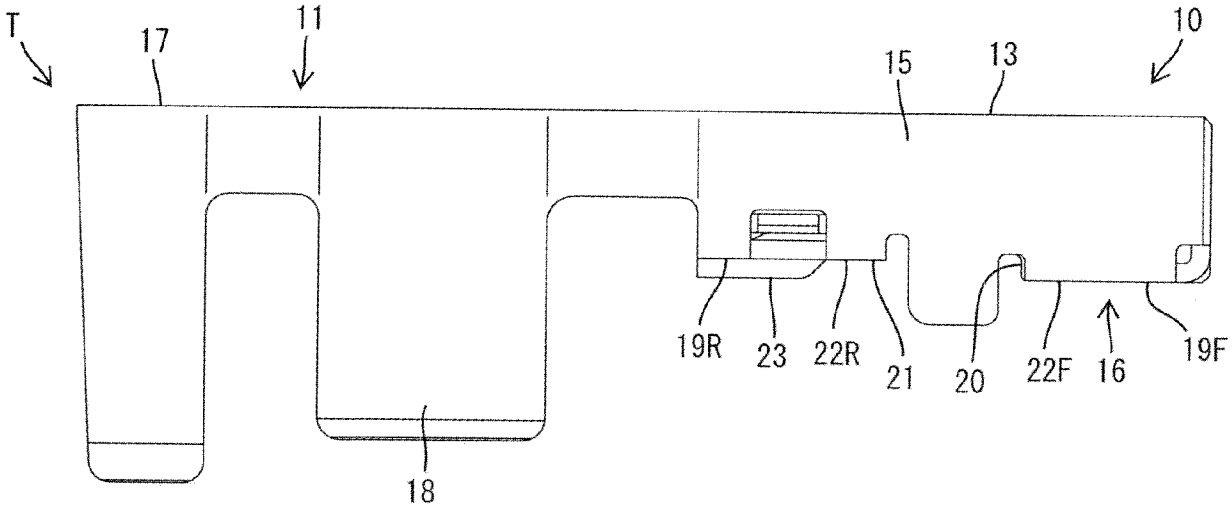
FIG. 6 is a side view of the terminal fitting.
Figure 7:
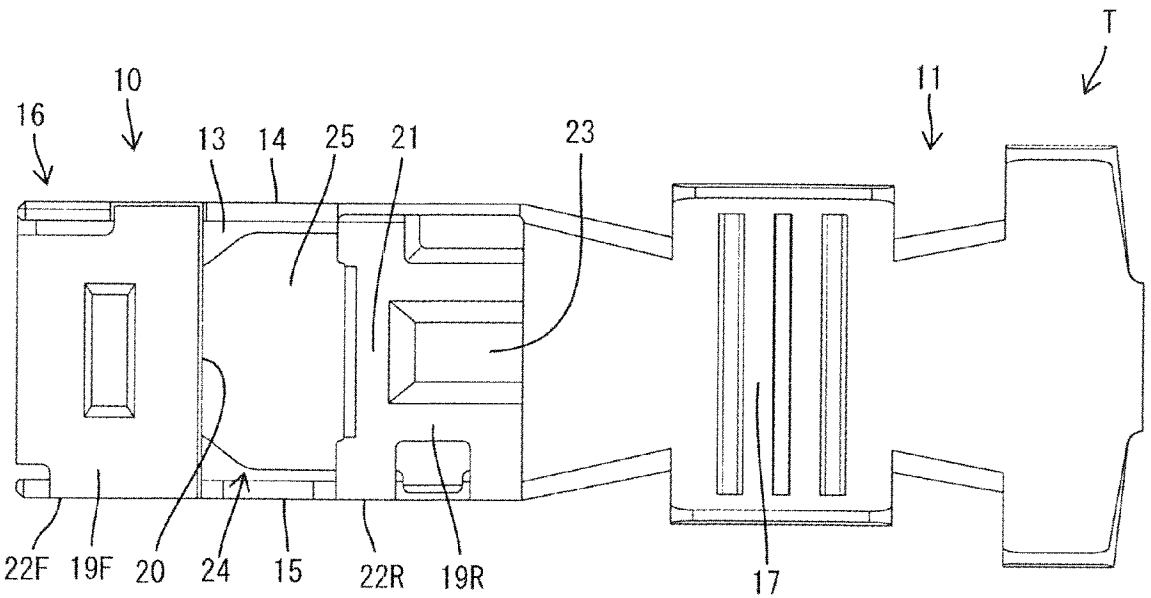
FIG. 7 is a bottom view of the terminal fitting.
Figure 8:
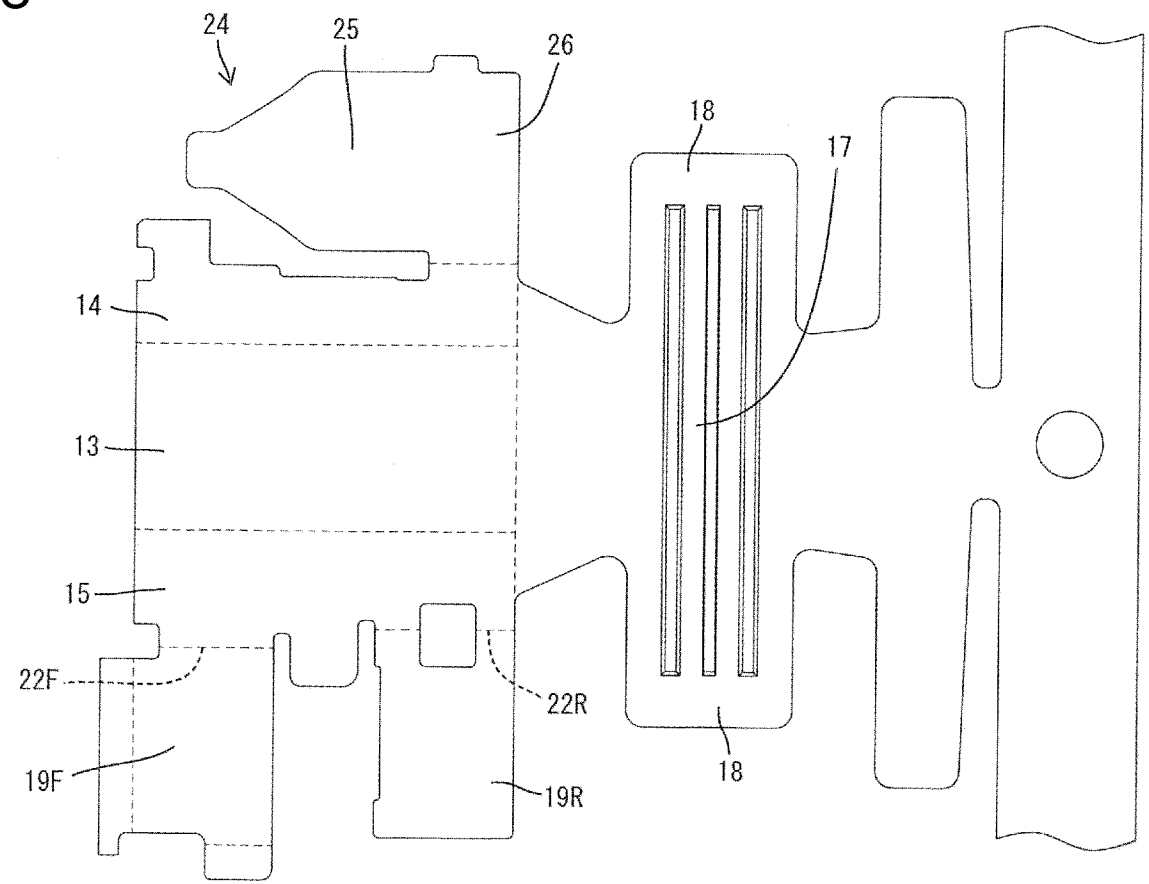
FIG. 8 is a development view of the terminal fitting.

As shown in FIGS. 1, 5 to 7, the lid 16 comprises a front plate 19F connected to a front part of the right side plate 15 and a rear plate 19R connected to a rear part of the right side plate 15. Left edges of the front and rear plates 19F and 19R contact or proximately face the lower end of the opposite left side plate 14 from below. A locking hole 20 is formed through the lid 16 between the front and rear plates 19F and 19R. As shown in FIG. 7, the locking hole 20 is a substantially rectangular opening that extends across an entire width of the rectangular tube 10 from an outer surface of the left side plate 14 to an outer surface of the right side plate 15. As shown in FIG. 1, the locking projection 34 is in the locking hole 20 when the terminal fitting T is inserted properly in the terminal accommodating chamber 31 and a front edge of the locking hole 20 (rear edge of the front plate 19F) engages the locking surface 36 of the locking projection 34 of the locking lance 32 from the front to retain the terminal fitting T.

A dimension of an opening area of the locking hole 20 in forward and backward directions (distance from the rear end of the front plate 19F to the front end of the rear plate 19R) is less than a distance from the front end (locking surface 36) to the rear end of the locking projection 34 in forward and backward directions, as shown in FIG. 1, to make the length of the rectangular tube 10 in forward and backward directions shorter. That is, the front edge of the rear plate 19R is located to correspond to a substantially central part of the inclined surface 37 of the locking projection 34 in forward and backward directions when the locking surface 36 of the locking projection 34 engages the front edge of the locking hole 20 (state where the terminal fitting T is retained). On the other hand, a part of the locking projection 34 is in the opening area of the locking hole 20 when the terminal fitting T is retained. Thus, the rear plate 19R of the lid 16 is formed with a retracted portion 21 to avoid interference of the lid 16 and the locking projection 34.

Figure 3:
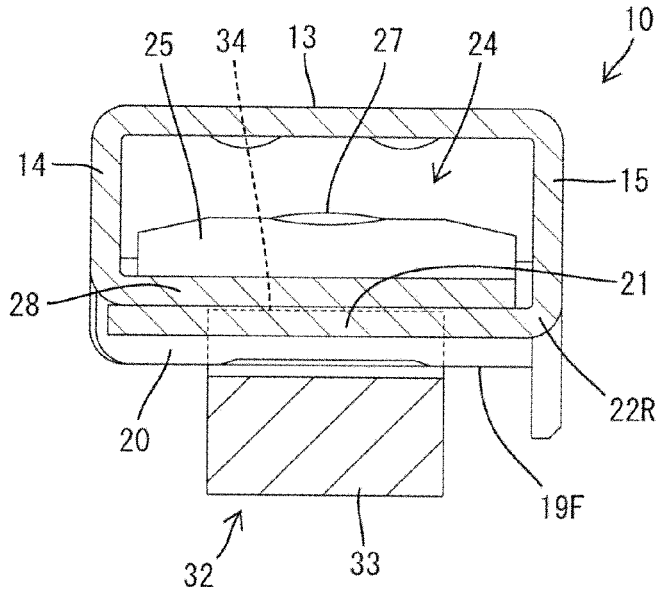
FIG. 3 is a section along B-B of FIG. 1.
Figure 4:
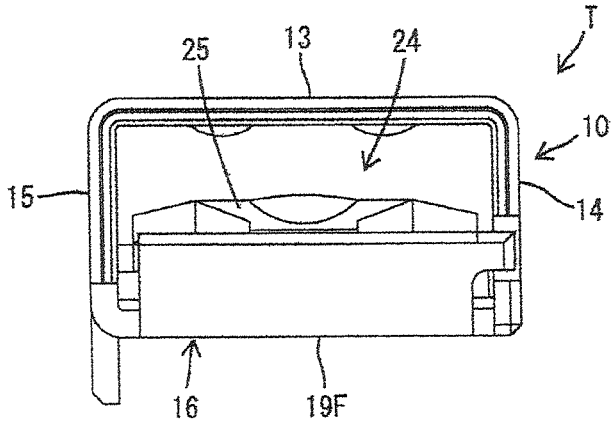
FIG. 4 is a front view of the terminal fitting.

As shown in FIGS. 1 and 7, the retracted portion 21 extends in forward and backward directions from the front edge of the rear plate 19R to a position slightly before a substantial center of the rear plate 19R in forward and backward directions. As shown in FIG. 1, the rear end of the retracted portion 21 is behind the rear end of the locking projection 34 when the terminal fitting T is retained. Further, as shown in FIGS. 3 and 7, the retracted portion 21 extends from the outer surface of the left or right side of the rear plate 19R of the lid 16 to a position inward of the outer surface of the other of the left and right side of the rear plate 19R.

As shown in FIG. 1, the lower surface of the retracted portion 21 facing the outside of the rectangular tube 10 is higher than the lower surface of the front plate 19F when the terminal fitting T is retained. That is, the retracted portion 21 is retracted away from the upper surface of the main body portion 33 of the locking lance 32 as compared with the front plate 19F. A retracting direction of the retracted portion 21 is the same as a projecting direction of the locking projection 34 from the upper surface of the main body portion 33. Further, there is a height difference between the retracted portion 21 and the front plate 19F within the range of a vertical engagement margin between the locking projection 34 and the locking hole 20. Note that, in the state where the terminal fitting T is retained, the upper surface (surface facing the interior of the rectangular tube 10) of the retracted portion 21 is at the same height as or slightly lower than the upper surface of the locking projection 34. The height difference between the retracted portion 21 and the front plate 19F prevents interference of the rear plate 19R with the locking projection 34.

As shown in FIG. 1, the retracted portion 21 is arranged to face the inclined surface 37 at the rear of the locking projection 34. As shown in FIG. 7, the retracted portion 21 forms an area of the rear plate 19R of the lid 16 behind and adjacent to the locking hole 20 over the substantially an entire width of the rear plate. In this way, an area in which the retracted portion 21 can be formed in the width direction is over the entire width of the rectangular tube 10. Such formation over the entire width could be realized for the following reason.

As shown in FIG. 7, the locking hole 20 is a through hole formed over an entire width in the lid 16 between the left and right sides of the lid, and the front plate 19F (area of the lid 16 before the locking hole 20 and where the retracted portion 21 is not formed) and the rear plate 19R (area of the lid 16 behind the locking hole 20 and where the retracted portion 21 is formed) are cantilevered from the right side plate 15 independently of each other. Thus, as shown in FIG. 6, the position of a rear fold line 22R between the rear plate 19R and the right side plate 15 can be higher (inward) from the position of a front fold line 22F between the front plate 19F and the right side plate 15. Thus, the height difference can be provided between the front and rear plates 19F and 19R. The rear plate 19R is cantilevered and hence can extend over the entire width of the rectangular tube 10 if an extending dimension is set appropriately. Thus, the retracted portion 21 can extend over substantially the entire width of the rectangular tube 10 to ensure a large engagement margin between the locking lance 32 and the locking hole 20 in the width direction.

As shown in FIGS. 1, 5 to 7, an area of the rear plate 19R behind the retracted portion 21 is hammered, deformed or bent to project in or down to form a posture stabilizer 23 that extends in forward and backward directions substantially from the rear end of the retracted portion 21 to the rear end of the rear plate 19R. Further, as shown in FIG. 7, the posture stabilizer 23 is formed in a widthwise central part of the rear plate portion 19R. As shown in FIGS. 1, 5 and 6, the lower surface of the posture stabilizer 23 is lower than the lower surface of the retracted portion 21 and substantially at the same height as the lower surface of the front plate 19F. In a state where the terminal fitting T is inserted in the terminal accommodating chamber 31 to be retained, the front plate 19F is placed on and in contact with the front receiving surface 35F and the posture stabilizer 23 is placed on and in contact with the rear receiving surface 35R, as shown in FIG. 1. Since the terminal fitting T is supported by the main body 33 of the locking lance 32 from below at positions before and behind the locking hole 20 (locking projection 34) to prevent the terminal fitting T from being inclined down or up toward the front.

As shown in FIGS. 1 to 4, a resilient contact piece 24 is accommodated in the tube 10 and resiliently contacts a tab of a male terminal fitting T (not shown) inserted into the rectangular tube 10 from the front. As shown in FIG. 1, the resilient contact piece 24 comprises a resilient displacing portion 25 curved to project up or in when viewed sideways and is arranged along the upper surface of the lid 16. A flat plate-shaped link 26 extends back from the rear end of the resilient displacing portion 25 and is connected at a substantially right angle to the extending lower end of the left side plate 14. A contact portion 27 for engaging the tab is defined at a highest or most projecting part of the resilient displacing portion 25. A support 28 is defined at a boundary between the rear end of the resilient displacing portion 25 and the front end edge of the link 26 and projects down like a rib for contacting or proximately facing the upper surface of the retracted portion 21. The resilient contact piece 24 is pressed out or down by the tab when the tab is inserted into the rectangular tube 10 and is displaced resiliently out or down about the support 28. The support 28 is supported from below by the retracted portion 21 to ensure a predetermined contact pressure between the resilient contact piece 24 and the tab.

The invention is not limited to the above described embodiment. For example, the following embodiments are also included in the scope of the invention.

Although the lid extends only from the right side plate in the above embodiment, two lids may extend from the left and right side plates and may be both formed with a retracted portion.

Although the posture stabilizer is formed by hammering in the above embodiment, it may be formed by cutting and bending.

Although the posture stabilizer is arranged at one position in the widthwise center in the above embodiment, it may be provided at a plurality of positions spaced apart in the width direction.

What is claimed is:

1. A terminal fitting having a tube extending in forward and backward directions and including a locking hole is formed at a front end part and which is retained not to come off backward by an engagement of a front end edge of the locking hole with a locking projection of a locking portion formed in a terminal accommodating chamber in a state where the terminal fitting is inserted properly in the terminal accommodating chamber, wherein the tube comprises:

a base plate;

first and second side plates extending from the base plate, each of the first and second side plates having inner and outer surfaces;

a lid opposite the base plate and formed with the locking hole, the lid having a front plate cantilevered from a front end of the first side plate, and arranged forward of the locking hole and a rear plate cantilevered from a rear end of the first side plate independently of the front plate and arranged behind and adjacent to the locking hole; and a retracted portion formed at the rear plate, retracted inwardly of the tube from the front plate to provide a height difference within a range of an engagement margin with the locking projection and capable of facing a rear end part of the locking projection, the retracted portion extending from the first side plate to at least the inner surface of the second side plate.

2. The terminal fitting of claim 1, further comprising at least one posture stabilizer formed behind an area of the retracted portion substantially facing the locking projection and projecting outwardly of the tube from an outer surface of the retracted portion.

3. The terminal fitting of claim 1, wherein a distance from a rear end of the front plate to a front end of the rear plate is shorter than a distance from a front end to a rear end of the locking projection in forward and backward directions.

4. The terminal fitting of claim 1, wherein the retracted portion extends from a front end of the rear plate to a position slightly before a substantial center of the rear plate in forward and backward directions.

5. The terminal fitting of claim 1, wherein the retracted portion is retracted in a direction away from an outer surface of a main body of the locking portion and in an inward direction of the tube as compared with the front plate.

6. A connector comprising:

a housing with a terminal accommodating chamber having a locking portion with a locking projection; and the terminal fitting of claim 1 inserted into the terminal accommodating chamber so that the locking projection engages the front end edge of the locking hole when the terminal fitting is properly inserted in the terminal accommodating chamber to prevent the terminal fitting from coming out backward.

7. A female terminal fitting with a tube having opposite front and rear ends, the tube comprising:

a base plate;

left and right side plates extending from the base plate;

a front plate cantilevered from the left side plate;

a rear plate cantilevered from the left side plate at a position spaced rearward the front plate so that a locking hole is formed between the front and rear plates, a retracted portion formed on the rear plate and being retracted inwardly of the tube relative to the front plate, the retracted portion extending from the left side plate to at least the right side plate.

8. The terminal fitting of claim 7, wherein the locking hole extends from the left side wall to the right side wall.

9. The terminal fitting of claim 7, further comprising at least one posture stabilizer formed behind an area of the retracted portion and projecting outwardly of the tube from an outer surface of the retracted portion.

10. The terminal fitting of claim 7, wherein the retracted portion extends from a front end of the rear plate to a position slightly before a substantial center of the rear plate in forward and backward directions.

11. A connector comprising:

a housing with opposite front and rear ends and a terminal accommodating chamber extending from the rear end toward the front end of the housing, a locking portion formed in the terminal accommodating chamber and having a locking projection with a front locking surface and an inclined rear surface; and a terminal fitting inserted in the terminal accommodating chamber and having a tube with opposite front and rear ends, the tube having a base plate, left and right side plates extending from the base plate, a front plate cantilevered from one of the side plates and a rear plate cantilevered from one of the side plates at a position spaced rearward the front plate so that a locking hole is formed between the front and rear plates for receiving the locking projection with the front locking surface engaging a rear end of the front plate, a retracted portion formed on the rear plate and being retracted inwardly of the tube relative to the front plate for accommodating the inclined rear surface of the locking projection, wherein the front plate, the rear plate, and the retracted portion extend from one of the side plates at least to the other of the side plates.

12. The connector of claim 11, wherein a distance from the rear end of the front plate to a front end of the rear plate is shorter than a distance from a front end to a rear end of the locking projection in forward and backward directions.

13. The connector of claim 11, wherein the retracted portion is retracted in a direction away from an outer surface of a main body of the locking portion and in an inward direction of the tube as compared with the front plate.

14. The connector of claim 11, wherein the locking hole extends between the left and right side plates.

* * * * *